US006315128B1

(12) United States Patent
Stromberg

(10) Patent No.: US 6,315,128 B1
(45) Date of Patent: Nov. 13, 2001

(54) TRAMP MATERIAL REMOVAL FROM PULP FEED SYSTEMS

(75) Inventor: C. Bertil Stromberg, Glens Falls, NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

(21) Appl. No.: 09/438,837

(22) Filed: Nov. 12, 1999

Related U.S. Application Data

(62) Division of application No. 08/905,324, filed on Aug. 4, 1997, now Pat. No. 6,024,227.

(51) Int. Cl.[7] ..... B07B 1/00; D21C 7/06

(52) U.S. Cl. ..... 209/241; 209/913; 162/52; 162/245; 162/246

(58) Field of Search ..... 209/241, 913; 198/370.01, 359, 657, 671; 162/52, 233, 238, 245, 246

(56) References Cited

U.S. PATENT DOCUMENTS

| | | | | |
|---|---|---|---|---|
| 4,151,083 | | 4/1979 | Dove | 209/725 X |
| 4,280,902 | | 7/1981 | Jacobsen et al. | 210/512.1 X |
| 4,323,445 | * | 4/1982 | Alekhin et al. | 209/913 X |
| 4,737,274 | | 4/1988 | Jacobsen et al. | 210/413 X |
| 4,743,338 | | 5/1988 | Prough | 162/56 X |
| 4,784,759 | * | 11/1988 | Elliott | 209/224 X |
| 5,622,598 | * | 4/1997 | Prough | 162/246 X |
| 5,672,245 | | 9/1997 | Andtbacka et al. | 162/55 X |
| 5,868,256 | * | 2/1999 | Teppo | 209/913 X |

OTHER PUBLICATIONS

MC® Tramp Material Separator, Kamyr Inc. Bulletin No. KGD 17959–WN 386.

Digester Update 4th Edition, Sep. 1981, Kamyr, Inc., Revised as of July, 1983.

* cited by examiner

*Primary Examiner*—Tuan N. Nguyen
(74) *Attorney, Agent, or Firm*—Nixon & Vanderhye P.C.

(57) ABSTRACT

Dense, tramp material, is efficiently separated in a comminuted cellulosic fibrous material feed system, for example in a chemical cellulose digester feed system, in a simple but effective matter. By merely utilizing a generally vertical conduit and a slurry flow within it (which may be augmented by high speed liquid introduction), that is caused to turn in a radiused path, centrifugal force allows separation of the tramp material into a cavity beneath the radius transition without requiring any mechanical element to engage the slurry. Appropriate purges, baffles, and discharge mechanisms may be provided. Alternatively, a tramp material separator may be built into an otherwise conventional metering screw in a digester feed system, or one or more centrifugal separators can be provided downstream of the slurry pump in a chip slurry transport system or digester feed system.

11 Claims, 8 Drawing Sheets

10
DIGESTER
FROM
TO
TO DIGESTER
11
12
13
14
15
16
17
18
19
20
21
22
23
24
25
26
27
28
29
30
31
32

TRAMP MATERIAL REMOVAL FROM PULP FEED SYSTEMS

This is a divisional of application Ser. No. 08/905,324, filed Aug. 4, 1997, now U.S. Pat. No. 6,024,227, the entire content of which is hereby incorporated by reference in this application.

BACKGROUND AND SUMMARY OF THE INVENTION

In the art of chemical pulping, natural cellulose material, for example, softwood chips, is treated to produce cellulose pulp from which paper products are made. As a prerequisite to this treatment, the cellulose material is typically introduced and conditioned prior to being formally "cooked" in pressurized vessels, that is digesters, by what is known in the art as a "feed system". Since their introduction in the 1940s and 1950s, feed systems for continuous digesters have been essentially unchanged. However, U.S. Pat. No. 5,476,572 introduced the first significant development to the means of feeding a chip slurry to a digester, either continuous or batch, since the initial development of chip feeding systems. The system disclosed in the U.S. Pat. No. 5,476,572 and marketed under the name LO-LEVEL® Feed System by Ahlstrom Machinery Inc. of Glens Falls, N.Y., first introduced the concept of pumping a slurry of chips and liquor into a high-pressure transfer device instead of using a downstream pump to draw the slurry into the transfer device. As described in the '572 patent (the disclosure of which is incorporated by reference herein) this system dramatically reduces the complexity of the overall feed system by permitting, among other things, the high pressure transfer device to be positioned at, for example, ground level instead of elevated as was required by the prior art. Further improvements to the system initially disclosed in the '572 patent are described in U.S. Pat. Nos. 5,622,598 and 5,635,025 (the disclosures of which are also incorporated by reference herein).

As disclosed in co-pending application Ser. No. 08/744,857, filed on Nov. 4, 1996 and Ser. No. 08/738,239, filed on Oct. 25, 1996, the ability to pump a slurry of chips provides numerous opportunities to improve the efficiency by which comminuted cellulosic material can be introduced to a cooking system. The present invention provides further improvements to the feeding system for the chemical treatment of wood, particularly wood chips. For example, one embodiment of the present invention comprises a refinement of the invention disclosed in application Ser. No. 08/744,857 (the disclosure of which is incorporated by reference herein). Specifically, one embodiment of this invention comprising the refinement of the system illustrated in FIG. 2 of application Ser. No. 08/744,857, wherein instead of splitting the flow path into two or more paths to distinct digesters, two or more flow paths are used to feed a single digester. This is particularly advantageous when the capacity of one component of the feed system is exceeded by the desired capacity of the entire pulping system, or if the cost of manufacturing a larger capacity device is either technically or economically unfeasible.

The present invention also addresses the problem of isolating and removing undesirable material from the fiberline to avoid interference with the process or damage to the equipment. The comminuted cellulosic fibrous material, for example, softwood chips, that are treated in conventional pulping systems typically contains non-cellulose debris, for example, sand, dirt, stones, miscellaneous metal parts (for example, nails, pieces of wire, nuts and bolts) or metal fragments, or other heavy cellulose (e.g. knots) or non-cellulose material. This material is collectively referred to as "tramp material", and typically has a density at least about 10% greater than the cellulose material being processed (e.g. at least 50% greater). Much of this material is separated during chip preparation, but some still passes to the digester feed system and to the digester itself. Conventionally, this material can be separated from the chips in the feed system by some form of separator. for example, a Tramp Material Separator marketed by Ahlstrom Machinery Inc., of Glens Falls, N.Y. One such Separator is shown schematically as item 12 in U.S. Pat. No. 4,743,338. This Separator is described in the brochure entitle "Digester Update", $4^{th}$ Edition, published in September 1981 by Kamyr, Inc. (now Ahlstrom Machinery Inc.) Tramp material may also be separated from the fiberline downstream of the digester, after the chips have been converted to a slurry of fibers and liquid. For example, the MC® Tramp Material Separator described in a 1986 pamphlet published by Kamyr, Inc., marketed by Ahlstrom Machinery Inc., and illustrated in U.S. Pat. No. 4,737,274, may be located in the blowline of a digester wherever convenient. Tramp material may also be separated from a liquid stream. U.S. Pat. No. 4,280,902 illustrates a cyclone-type separating device for removing undesirable material, in particular sand and the like, from a liquid stream in the feed system. This device is marketed under the name Sand Separator by Ahlstrom Machinery Inc. Though these devices have proven to be effective in removing tramp material from the feed systems of digesters, the introduction of the Lo-Level® feed system provides additional novel methods for isolating and removing such undesirable material.

According to one aspect of the present invention a tramp material separator for use in a comminuted cellulosic fibrous slurry feed system, e.g. for a digester, is provided. The separator comprising the following components: A first conduit having a top portion including an inlet and a bottom portion below the top portion, and an outlet. Means for providing centrifugal force on a slurry flowing in the first conduit to cause less dense solids in the slurry to move in a first flow path, and more dense, tramp material, solids in the slurry to separate from the first flow path and move in a second flow path under the influence of centrifugal force; the means for providing centrifugal force consisting essentially of a radiused section of the first conduit adjacent the bottom portion thereof, so that no moving or powered elements are provided for effecting separation. And a cavity defined adjacent and below the radiused section of the first conduit for receipt of more dense solids flowing in the second flow path.

This system may be used to feed comminuted cellulosic fibrous material to a digester, continuous or batch, or it may be used in any system that transfers comminuted cellulosic fibrous material that contains tramp material that is preferably separated and removed. For example, this system may be used in a chip transport system as disclosed in copending application Ser. No. 08/738,239 filed on Oct. 25, 1997 (the disclosure of which is included here by reference).

The separator may further comprise a baffle adjacent a portion of the cavity most downstream of the cavity in the first flow path, the baffle extending into the first flow path to aid in directing more dense, tramp material, solids into the cavity and retaining the tramp material in the cavity. Also the tramp metal separator preferably further comprises a nozzle for introducing liquid into the top portion of the first conduit at high speed so as to maximize the flow rate of slurry in the first flow path, and thereby enhance the centrifugal force moving more dense, tramp material, solids in the second path.

The separator may further comprise means for intermittently removing tramp material from the cavity, or for continuously removing it. The intermittent removal means may comprise any conventional device for removing trapped material. Preferably the means for intermittently removing tramp material from the cavity comprises a first valve closest to the cavity, a second valve remote from the cavity, and a chamber between the first and second valves, the first and second valves independently operable (although a conventional system/interlock is used to see that they are not both open at the same time) to allow tramp material to collect in the chamber when the first valve is open and the second valve is closed, and to allow discharge of tramp material from the chamber when the second valve is at least partially opened and the first valve is at least partially closed.

The separator also preferably comprises means for establishing a purged flow of fluid into the cavity for effecting movement of less dense solids (the cellulose material itself that flow into the cavity back into the first flow path. The purge flow establishing means may comprise any suitable conventional conduit, nozzle, deflector, valve, baffle, or the like that secures the desired purge flow.

The first conduit may be substantially circular in cross section (although it might also be rectangular or have other configurations), and may have a first diameter at the top portion thereof and a transition to a second diameter larger than the first diameter at the bottom portion thereof before the outlet. The first conduit, including the radius section thereof, may make substantially a 90° angle from the inlet to the outlet, the outlet being substantially horizontal and the inlet substantially vertical.

Note that the separation of tramp material from chip or fiber slurries according to the invention is different from the separation of undesirable or oversized material from low or medium consistency pulp streams. These processes which are typically referred to as "cleaning" or "screening", typically separate much smaller debris or uncooked wood material from the pulp stream. The present invention is particularly applicable to the separation of tramp material from a slurry of cellulose chips and liquid in the feed system of a digester, either continuous or batch.

Another embodiment of the present invention comprises an improvement of the feed system described U.S. Pat. No. 5,622,598 and in copending application Ser. No. 08/744,857 to remove tramp material from the feed system. This embodiment includes a conveyor for feeding comminuted cellulosic fibrous material including at least some tramp material, comprising: a housing having a first end and a second end; an inlet located adjacent said first end; an outlet adjacent said second end; a screw conveyor extending from said first end to said second end for conveying said material from the inlet to the outlet; a cavity located beneath the conveyor for collecting tramp material; a liquor inlet in the cavity for introducing liquid to the cavity so that the liquid agitates and conveys the desirable fibrous material from the cavity to the outlet while allowing the undesirable tramp material to collect in the cavity; and means for removing the collected tramp material from the cavity.

That is, according to this aspect of the present invention a chemical cellulose pulp digester feed system is provided comprising (as conventional components) a chip bin, a metering device, a conduit for entraining comminuted cellulosic material from the metering device in cooking liquor to provide a slurry, and a transfer device for pressurizing the slurry for feeding it to a digester; and according to the present invention, the metering device comprises a substantially horizontal axis metering screw having a housing with an inlet, an outlet, a rotating screw extending between the inlet and the outlet inside the housing, and a tramp material separator between the inlet and the outlet. Preferably the tramp material separator comprises a cavity adjacent the outlet, and extending downwardly from the screw housing so that more dense, tramp material, solids will flow into the cavity due to density differences between the tramp material and the slurry, and as a result of the rotating screw moving the more dense tramp material outwardly toward the housing. The system preferably further comprises means for establishing a purge flow of fluid into the cavity for effecting movement of less dense solids that flow into the cavity back out of the cavity while allowing more dense tramp material to flow into the cavity. There may also further be means for intermittently removing the tramp material from the cavity, as described above.

Another embodiment of this invention comprises an apparatus for treating comminuted cellulosic fibrous material including at least some tramp material, comprising: a cylindrical treatment vessel (e.g. chip bin) fed with comminuted cellulosic fibrous material; a metering device operatively connected to the treatment vessel; a conduit operatively connected to the metering device and having means for isolating said tramp material from the comminuted cellulosic fibrous material; and a pump operatively connected to the conduit having an outlet operatively connected to at least one digester. The treatment vessel is preferably a steaming vessel in which the comminuted cellulosic fibrous material is exposed to steam. Furthermore, this vessel is preferably a Diamondback® steaming vessel sold by Ahlstrom Machinery Inc. and described in U.S. Pat. No. 5,500,083. The means for feeding material to the steaming vessel may be any form of device which can introduce comminuted cellulosic fibrous material to a vessel but is preferably one that minimizes or prevents the escape of gases while material is being introduced, such as a screw-type conveyor having a hinged gate as disclosed in co-pending application Ser. No. 08/713,431 filed on Sep. 13, 1996 (the disclosure of which is incorporated by reference herein).

The metering device may be any form of suitable metering device, such as a Chip Meter as sold by Ahlstrom Machinery Inc., but is preferably a screw-type metering device as disclosed in U.S. Pat. No. 5,622,598, having one or more parallel screws. The conduit may be any form of pipe, chute, or tube for conveying the chips by means of gravity from the metering device, but is preferably a tube having a radius of curvature as shown in co-pending application Ser. No. 08/738,239, or a radiused elbow.

The means for isolating the tramp material preferably comprises or consists of a cavity or "trap" located in the metering device or in the conduit leading from the metering device to the pump, and as described above.

According to another aspect of the present invention, a chemical cellulose pulp digester feed system is provided comprising the following conventional components: a chip bin, a metering device, a conduit for entraining comminuted cellulosic material from the metering device in cooking liquor to provide a slurry, a tramp material separator, and a transfer device for pressurizing the slurry for feeding it to a digester. According to the invention the transfer device comprises a slurry pump for feeding slurry to a feeder, and the tramp material separator comprises a cyclone separator between the slurry pump and the feeder. The feed system further preferably comprises a plurality of the cyclones connected between the slurry pump and the feeder, either in series or in parallel, and optionally connected to the plurality of feeders.

According to another aspect of the present invention, a method of separating tramp material from a slurry of cellulosic fibrous material in a liquid having a solids consistency of at least 5% (preferably the conventional solids consistency for feeding a slurry of comminuted cellulosic fibrous material to a continuous or batch digester, typically about 10–15%). In this context, it is to be understood that a solids consistency of, for example, 5%, refers to the weight percent of the non-dissolved solids, for example the wood chips, in the slurry. Liquid streams in and around pulp mills often contain dissolved solid material, the content of which is typically expressed as a percent. The method comprises the following steps: (a) causing the slurry to flow in a generally downward flow in a first flow path. (b) Without impacting the slurry with a rotating or reciprocating mechanical member, causing the first flow path to bend smoothly and sharply toward the horizontal, so as to provide a centrifugal force on the slurry to cause less dense solids in the slurry to continue to move in a first flow path, and more dense, tramp material, solids in the slurry to separate from the first flow path and move in a substantially downward second flow path under the influence of centrifugal force into a cavity below the first flow path. And (c) removing the separated tramp material from the cavity.

Step (b) may be further practiced by introducing liquid under high speed into the slurry so as to maximize the flow rate of slurry in the first flow path, and thereby enhance the centrifugal force moving more dense, tramp material, solids in the second path. There may also be the further step of introducing a purge flow of fluid into the cavity for effecting movement of less dense solids that flow into the cavity back into the first flow path. There also may be the further step of placing a baffle adjacent a portion of the cavity most downstream of the cavity in the first flow path so that the baffle extends into the first flow path to aid in directing more dense, tramp material, solids into the cavity and retaining the tramp material in the cavity. The apparatus for practicing the method is preferably as described above.

It is a primary object of the present invention to provide an effective method and system for feeding a chemical pulp digester, and particularly tramp material separating structures and methods associated therewith. This and other objects of the invention will become clear from an inspection of the detailed description of the invention and from the appended claims.

DETAILED DESCRIPTION OF THE DRAWINGS

Figure 1:
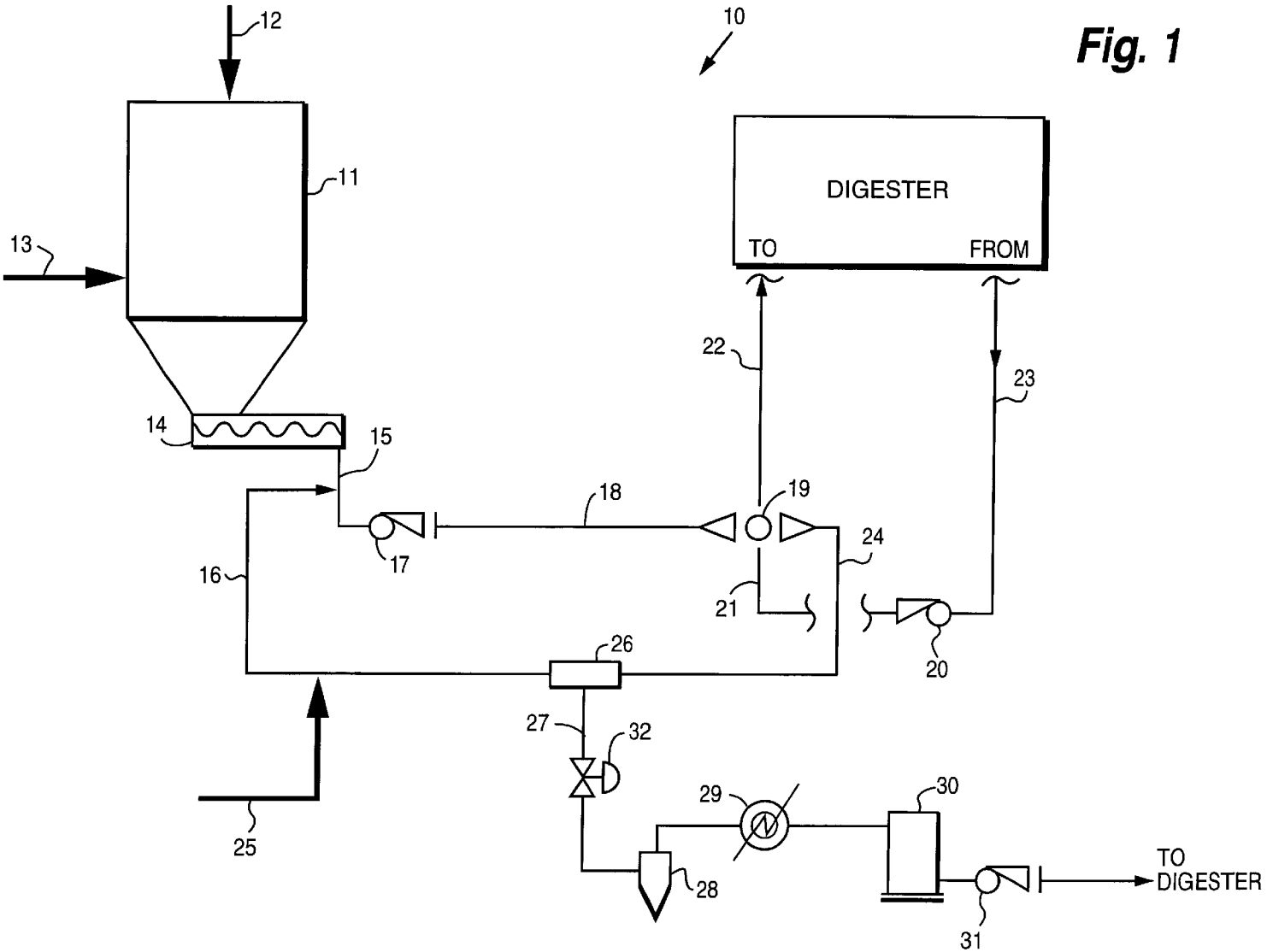
FIG. 1 is a schematic view illustrating a first embodiment of an exemplary system according to the present invention.

One typical system 10 for feeding a slurry of comminuted cellulosic fibrous material to one or more pulping vessels, or digesters (either continuous or batch), that can be used to employ the present invention, is shown in FIG. 1. For the sake of illustration, the following discussion will be limited to the use of the term "chips" when referring to comminuted cellulosic fibrous material. However, it is to be understood that this invention is not limited to handling hardwood or softwood chips only, but the present invention can be used to handle any form of comminuted cellulosic fibrous material including sawdust; grasses and the like, such as kenaf; agricultural waste, such as bagasse; and recycled material, such as old newsprint (ONP), and old corrugated containers (OCC), and the like.

The system 10 includes a Chip Bin, 11, which is preferably a Diamondback® Chip Bin as marketed by Ahlstrom Machinery Inc. and described in U.S. Pat. Nos. 5,500,083, 5,617,975, and 5,628,873. Wood chips 12 are introduced to the Chip Bin 11 and steam 13 is added to the bin 11 to pretreat the chips. As is typical of Diamondback Chip Bins 11, the steamed chips pass through a transition having one-dimensional convergence and side relief such that the treated chips are discharged from the bin uniformly steamed and without the aid of mechanical vibration. The steamed chips are discharged to a metering device 14 typically a metering screw as described in U.S. Pat. No. 5,622,598 and copending application Ser. No. 08/713,431 filed on Sep. 13, 1996. Alternatively, a Chip Meter, as sold by Ahlstrom Machinery Inc., or other conventional metering device may be used. Cooking liquor, for example, kraft white liquor, green liquor, or black liquor, may be added to the metering device 14 if desired. This liquor may include strength or yield enhancing additives, such as anthraquinone or polysulfide and their derivatives.

The metering device 14 typically transports and discharges steamed or pretreated material to conduit 15 for transport to slurry pump 17. The conduit 15 may be a pipe or tube, but is preferably a Chip Tube, as sold by Ahlstrom Machinery Inc. having a radius of curvature. Cooking liquor is also preferably added to conduit 15 via conduit 16 to produce a level of liquid in conduit 15. Conduit 16 may introduce liquor to one or more locations along conduit 15, but liquor is preferably introduced at or near the radiused area of the conduit to promote movement of the slurry through the conduit and into the inlet of the pump 17. The pump 17 is preferably a screw-type slurry pump such as a "Hidrostal" pump manufactured by Wemco of Salt Lake City, Utah, though other types of slurry pumps may be used.

As disclosed in U.S. Pat. No. 5,476,572 (the disclosure of which is incorporated by references herein), pump 17 transports a pressurized slurry of chips via conduit 18 to the low pressure inlet of a high pressure transfer device 19, for example, a High-pressure Feeder (HPF) as sold by Ahlstrom Machinery Inc. As is conventional, the chip slurry is discharged from the pocketed high-pressure transfer device 19 and passed to the inlet of a conventional digester (shown schematically in FIG. 1) via conduit 22 by high-pressure pump 20. Excess liquor removed from the inlet of the digester and passed via conduit 23 is pressurized by pump 20 and introduced to the high-pressure inlet of device 19 via conduit 21. Liquor is removed from device 19 via a low pressure outlet and conduit 24. Conduit 24 communicates with conduit 16 to supply the liquor introduced to chute or chip tube 15. The liquor in conduit 24 may be heated or cooled as desired before introducing it to chute 15. Cooking liquor, as described above, is typically introduced to conduit 16 via conduit 25.

As shown in U.S. Pat. No. 5,476,572, two or more high-pressure transfer devices, 19, may be fed by pump 17 by dividing the flow in conduit 18 into two or more flows feeding individual transfer devices 19. The transfer devices 19 may feed the same or two or more different digesters. Each transfer device 19 can have its own circulations 21, 22, 23, and 24 to one or more digesters, their own pumps 20 for returning liquor from the respective digesters, and their own drainers 26 for controlling the volume of liquid. These circulations may also be combined to minimize the amount of equipment and piping required, for example, two or more circulations 24 associated with separate transfer devices 19 can be combined into a single pipeline prior to introducing the liquor to a single drainer 26 and a single conduit 16. Also, two or more return circulations 23 can be combined to feed a single pump 20 before being divided into two or more high-pressure flows 21. Other combinations which minimize piping and equipment are also conceivable.

Figure 6:
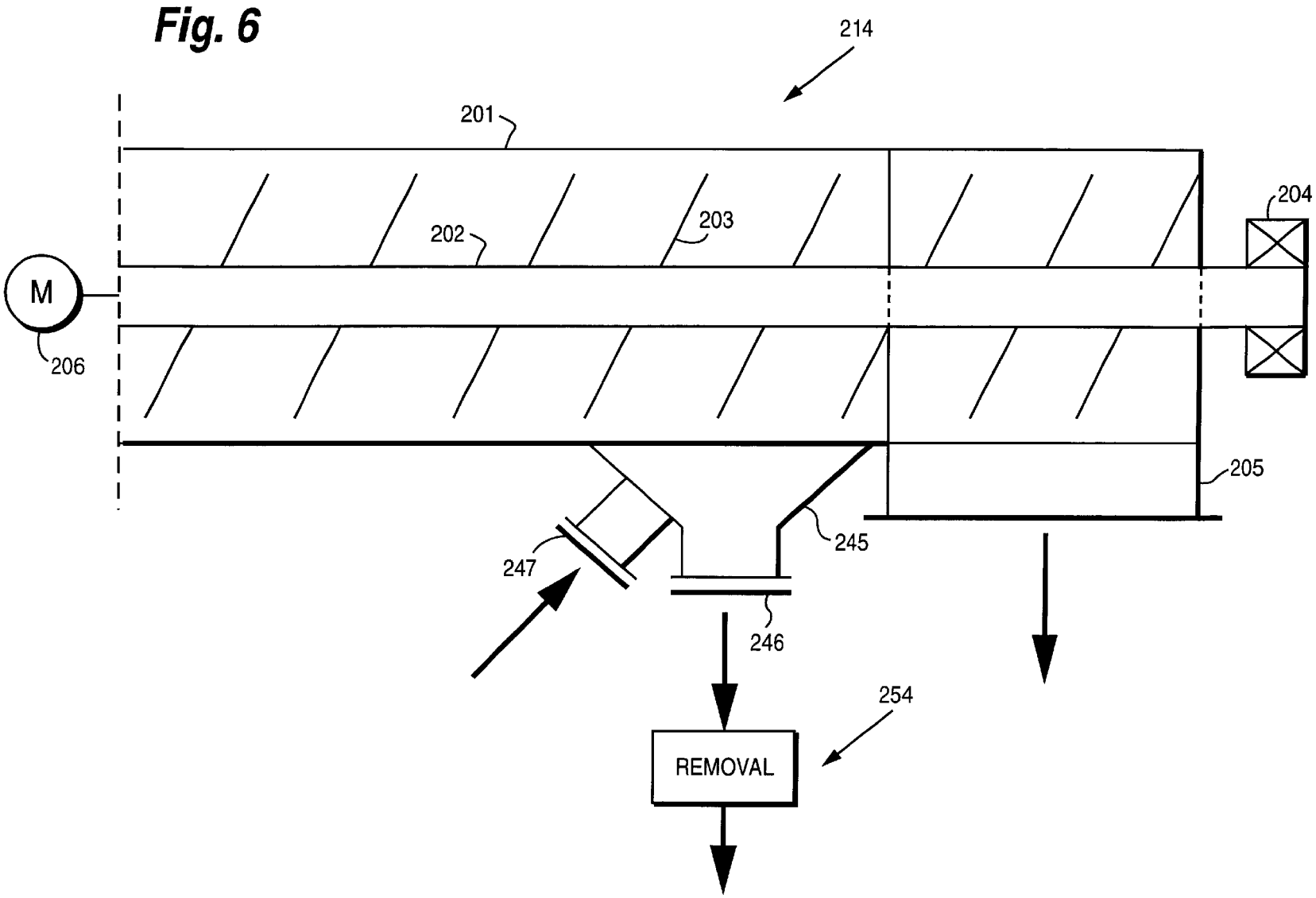
FIG. 6 is a side schematic view illustrating another exemplary form of a tramp material separator for use in a digester feed system according to the invention.

Excess liquor is removed from conduit 24 by a liquor removal device 26. The device 26 may be a conventional In-line Drainer as shown in FIG. 6 of U.S. Pat. No. 5,536,366 and sold by Ahlstrom Machinery Inc., though any other suitable known liquor removal device may be used. The excess liquor in conduit 27 may be treated in a separating device 28, for example, a cyclone-type Sand Separator also sold by Ahlstrom Machinery Inc., to remove undesirable sand or other foreign matter from the liquor. When the liquor in conduit 27 contains high sand contents, the separator 28 may comprise a gravity-clarifying or filter-type device to remove the sand and other debris. Since the feed system shown in FIG. 1 can be operated at temperatures below the temperatures at which the liquor boils, the feed system of FIG. 1 is particularly suited for use with a filter or clarifier as the separating device 28.

The liquor may also be cooled in a conventional cooling heat exchanger 29 and stored in a liquor storage tank 30, such as a Level Tank sold by Ahlstrom Machinery Inc., before being introduced to the one or more digesters as a source of make-up liquor by pump 31. The flow from the drainer 26 through conduit 27 can be controlled by valve 32. This flow may be regulated to control the level of liquor in tank 30.

Figure 2:
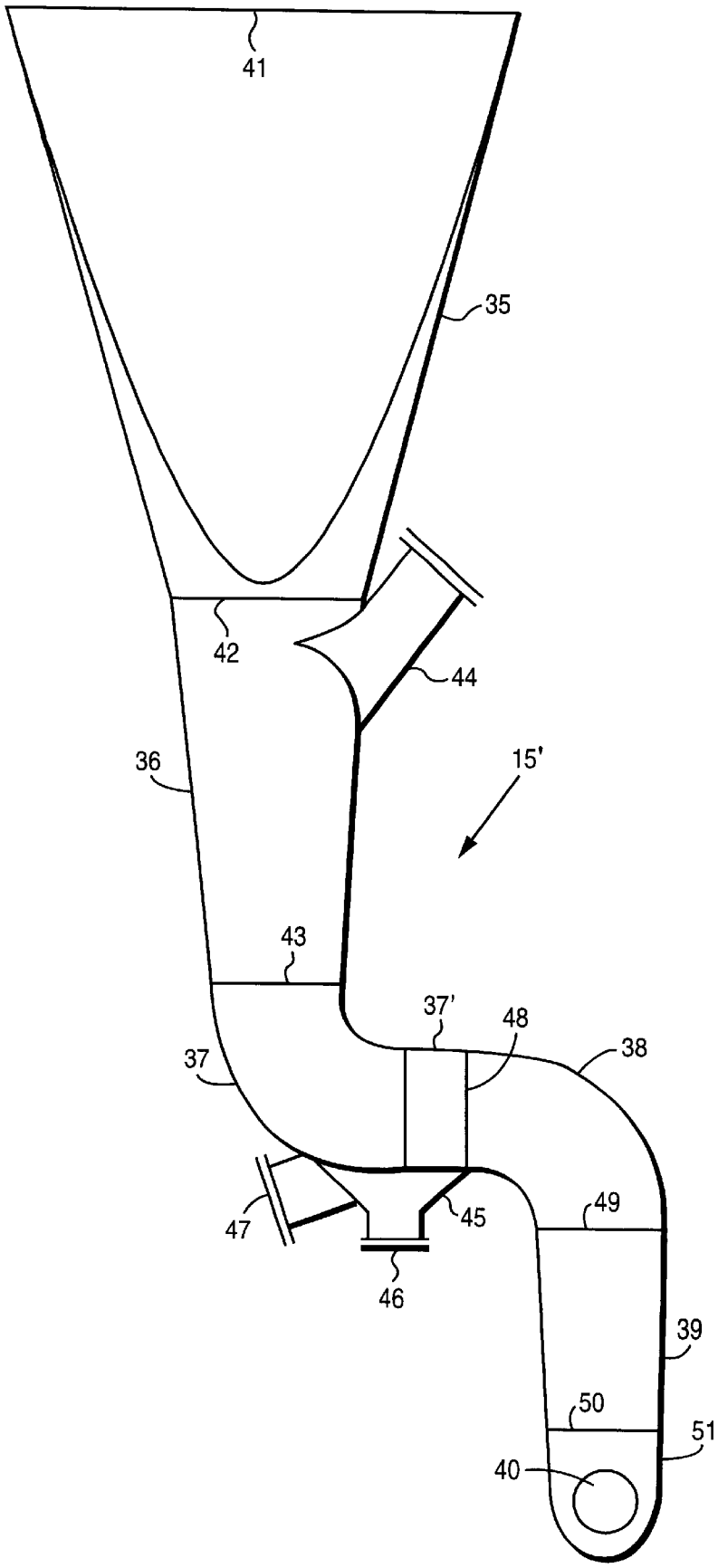
FIG. 2 is a detailed side view of an exemplary tramp material separator utilizable in the system of FIG. 1.

FIG. 2 illustrates one embodiment of the present invention as it applies to the chute or tube 15 of FIG. 1. That is, FIG. 2 illustrates one pipe arrangement for removing tramp material from the feed line according to the present invention. The pipe arrangement comprises several pipe sections 35, 36, 37, 38, 39, and 51 between the outlet of a metering device, for example, screw 14 of FIG. 1 (or other metering device), and the inlet to pump 17 of FIG. 1. Section 35 comprises or consists of a transition from a generally rectangular cross section 41 to a generally circular cross section 42. For example, cross section 41 my be a 4-foot by 8-foot rectangular opening that corresponds to the rectangular outlet of a screw conveyor 14, and section 42 may be a circular cross section corresponding to a mating circular pipe section 36. However, these sections are only given for illustration and any other shape of section, depending upon the requirements of the installation, may be used. Though section 35 may exhibit single-convergence and side relief, it need not. Section 35 may also have a convergence angle that is less than the critical convergence angle of the slurry being transferred. For example, the angle of convergence of section 35 may be between 1 and 30 degrees from the vertical.

Section 36 preferably comprises or consists of a conical reducer section having an upper end 42 corresponding to and mating with the first section 35, and a lower end 43 having an equal or smaller cross section. For example, the upper end may have a circular cross section having a 3-foot diameter and the lower end may have a circular cross section having a 2-foot diameter. Section 36 preferably includes at least one nozzle inlet 44 for introducing liquid, for example, for introducing liquid via conduit 16 of FIG. 1. The one or more nozzles 44 are preferably angled downwardly to promote the movement of chips and liquid through section 36 and through the downstream sections 37–39. Section 36 may also have a convergence angle that is less than the critical convergence angle of the slurry being transferred. For example, the angle of convergence of section 36 may be between 1 and 30 degrees from the vertical. Though the upper circular end of section 36 is shown concentric with the lower end, these need not be concentric but they may be offset. Section 36 mates with the inlet to section 37 at 43.

Section 37 typically comprises or consists of a radiused conduit or pipe elbow that transfers the slurry from the bottom of section 36 to section 38. Section 37 as shown in FIG. 2 includes a divergent pipe portion 37' that transitions to the larger diameter of section 38. This increase in diameter may be necessary due to the liquid introduced via inlet 47. Divergent portion 37' may not be necessary depending upon the flow and physical requirements of the installation (i.e. section 37 may mate directly with section 38).

A novel feature of the embodiment of the invention in FIG. 2 comprises or consists of a cavity 45 located beneath section 37. The cavity 45 includes a liquid inlet 47 and an outlet 46. The cavity 45 is positioned along the outer radius of radiused section 37 such that the centrifugal forces exerted on any tramp material present in the slurry flowing through section 37 will cause the tramp material to flow towards the outermost surface of the section and collect in cavity 45. Liquid added via conduit 47 acts as a dilution and purge to carry lighter, preferably cellulosic, material from cavity 45 to pipe section 38. The heavier, undesirable tramp material is less affected by the purge flow introduced in conduit 47 and settles to the bottom of cavity 45 (see arrows in FIG. 3). The tramp material may be removed continuously through outlet 46, or may be intermittently removed.

Figure 3:
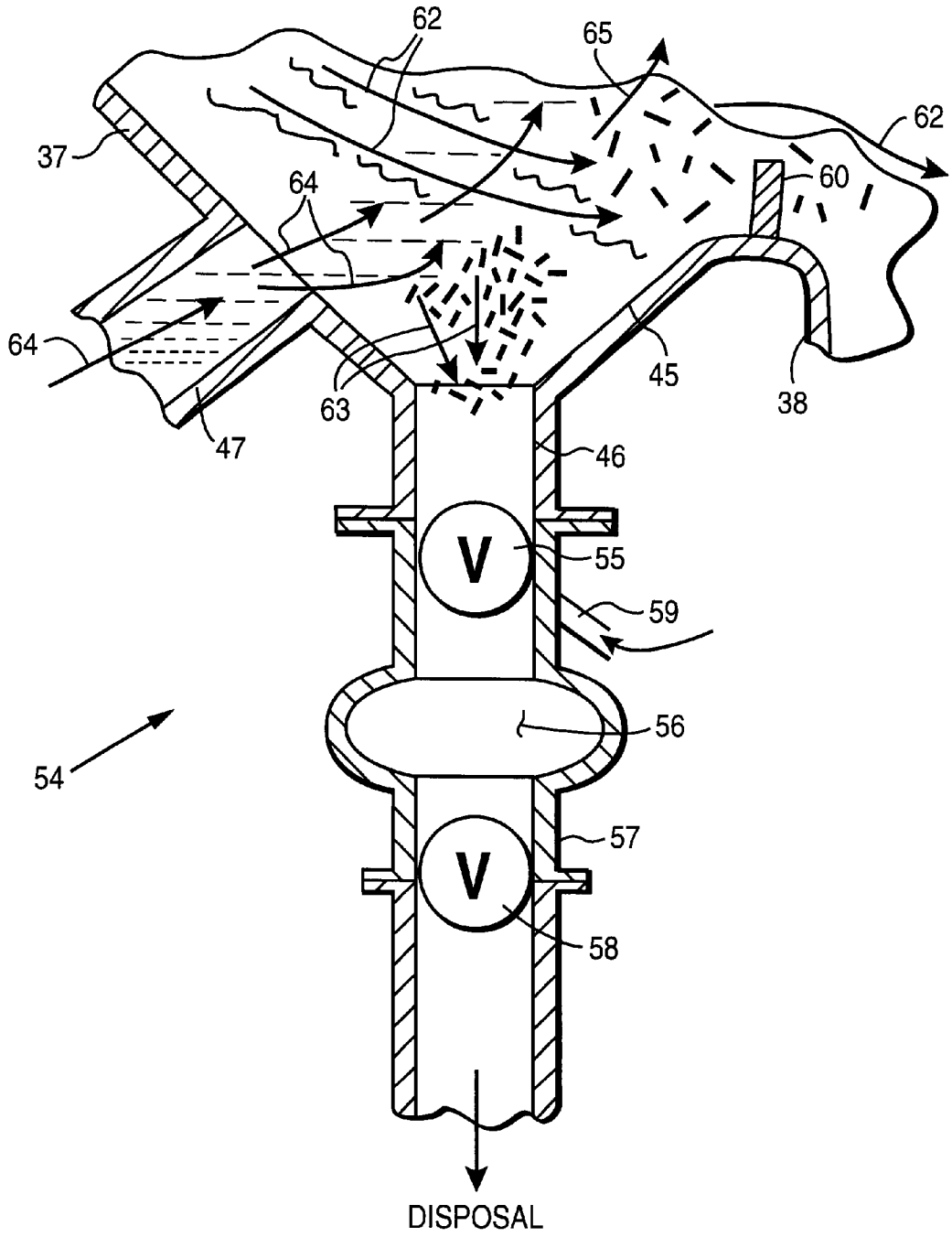
FIG. 3 is a side cross sectional view at a critical portion of the tramp material separator of FIG. 2, and showing the slurry and solids flows therein.

One preferred method of intermittently removing tramp material from the bottom of cavity 45 is by using a conventional double-valve arrangement, as shown in FIG. 3 at 54. In such a conventional arrangement 54, a first valve 55 is located in outlet 46. When valve 55 is at least partially open, it allows the tramp material present in cavity 45 to fall into a second cavity 56 having an outlet 57. After at least mostly closing the first valve 55, a second valve 58 in the outlet 57 of the second cavity 56 can be at least mostly opened to discharge the contents of the second cavity 56 to disposal. This second cavity 56 can be equipped with a conventional liquid purge 59 to aid in discharging the tramp material from the second cavity 56.

FIG. 3 also shows the particular fluid and material flow from practicing separation of the denser tramp material utilizing the system of FIG. 2. The slurry, typically at least at about 5% consistency (e.g. 5–25%, preferably about 10–15%), is caused to flow in a generally outflow in the first flow path defined by the conduit section 36 in the top of the radius section 37. Then the curvature of the radius section 37, without impacting the slurry with a rotating or reciprocating mechanical member, causes the first flow path to bend smoothly and sharply toward the horizontal, as indicated by arrow 62 in FIG. 3, so as to provide a centrifugal force on the slurry to cause less dense solids in the slurry to continue to move in the first flow path 62, and more dense (tramp material) solids in the slurry to separate from the first flow path 62 and move at a substantially downward second flow path 63 under the influence of centrifugal force into the cavity 45 below the first flow path 62. The separated tramp material is removed from the cavity 45 such as by utilizing the structure 54 as described above.

Preferably the purged flow 64 is introduced into the cavity 45 for effecting movement of less dense solids that flow into the cavity 45 back into the first flow path 62. The purge flow of liquid 64 is introduced via conduit 47, and the less dense material is shown at arrow 65 being moved by the purge liquid flow 64 out of cavity 45 into the first flow path 62.

The centrifugal force moving the tramp material in the second path 63 may be enhanced by introducing liquid under high speed into the slurry using nozzle 44. This maximizes the flow rate of the slurry in the first flow path 62, and enhances the effect of centrifugal force, while not diluting the consistency of the material by more than about 1–2%.

The baffle 60 may be provided at a portion of the cavity 45 adjacent to or at the most downstream part of cavity 45 extends into the first flow path 62 to aid in directing more dense, tramp material, solids into the cavity 45, and to retain the tramp material in the cavity 45, the flow of the main body of the slurry in flow path 62 merely moving over the baffle 60 and continuing to flow into the conduit 38. Baffle 60 may be vertically oriented, as shown, or it may be angled in a direction pointing upstream of the flow 62.

FIG. 2 illustrates an approximately 90-degree pipe elbow 37 oriented so that the center-line of its radius of curvature is parallel to the ground. This orientation provides the maximum utilization of gravity for accelerating the slurry and generating a centrifugal field to isolate denser tramp material. The centrifugal separating effect may be enhanced by providing an angle for section 37 that is greater than 90-degrees, for example, the pipe section may comprise or consist of a 180-degree section with the cavity or trap 45 located at the base of the section similar to a trap on the drain pipe of a conventional sink. If the centrifugal acceleration is suffeicent to separate denser materials, section 37 may also be less than a 90-degree bend. In addition, the centerline of the radius of curvature of section 37 need not be parallel to the ground and numerous orientations of section 37 are possible according to the invention. However, the position of cavity 45 is such that, whatever the orientation, cavity 45 is positioned along the outer radius of the section.

The velocity of the slurry through section 37 need not be dependent upon gravity, but may be defined by the rate at which liquid is introduced into nozzle 44. For this reason, the nozzle 44 is preferably orientated to maximize the rate of flow of the slurry through the outer radius of section 37 to enhance the centrifugal field and hence to enhance the separation of tramp material.

Also, section 37 is shown circular in cross section, but it need not be circular. For example, in order to expose the most slurry to the greatest centrifugal separation force, the section 37 can be rectangular in cross section. A rectangular cross section will provide a greater volume at a larger radius for the denser tramp material to separate. With a rectangular cross section, more of the slurry will flow through a radius of larger curvature than the flow path provided by a circular cross section.

In order to further ensure that tramp material is separated and settles into cavity 45, the downstream edge of cavity 45 may include a projection into the slurry stream baffle plate 60 (see FIG. 3) to aid in directing tramp material to the cavity 45 and for retaining it within the cavity 45.

Pipe section 37 discharges to pipe section 38. Section 38 also preferably includes a radius of curvature that accounts for the curvature of section 37 and directs the flow toward the inlet 40 of pump 17. Section 38 may be uniform in diameter or may have a convergent or divergent diameter as needed. For example, as shown in FIG. 2, the 2-foot diameter of section 37 may be increased by divergent portion 37' to a diameter of 2½ feet at cross section 48 and then section 38 may converge from 2½ feet in diameter to 2 feet at cross section 49. Section 38 may be rectangular in cross section instead of circular, or provide a transition from rectangular cross section to circular cross section.

Slurry from section 38 is fed to pipe section 39. Section 39 transfers the slurry from cross section 49 to cross section 50. Section 39 too may be convergent, divergent, or of constant cross section. Section 39 may also be circular or rectangular in cross section, or provide a transition from rectangular cross section to circular cross section. Section 39 discharges to section 51.

Section 51 directs the slurry to inlet 40 of pump 17 (see FIG. 1). Section 51 is typically radiused in a manner similar to sections 37 and 38 and directs the slurry from a vertical flow path to a horizontal flow path into the inlet of the pump 17. The radiused nature of section 51 is not seen in FIG. 2 since it is directed into the page of FIG. 2. Section 51 may be convergent or divergent but is preferably uniform in cross section. Section 42 may be circular or rectangular in cross section or provide a transition from rectangular cross section to circular cross section.

FIG. 2 illustrates a preferred configuration of the separator system of the invention, but other alternatives are conceivable that are still within the scope of the invention. For example, a feed system may include more than one tramp material trap 45. A trap similar to cavity 45 may also be located in radius section 51. Also, section 37, 37' may discharge directly to the inlet 40 of pump 17 so that only a single radiused section 37 is required and pipe sections 38, 39, and 42 are unnecessary.

Figure 4:
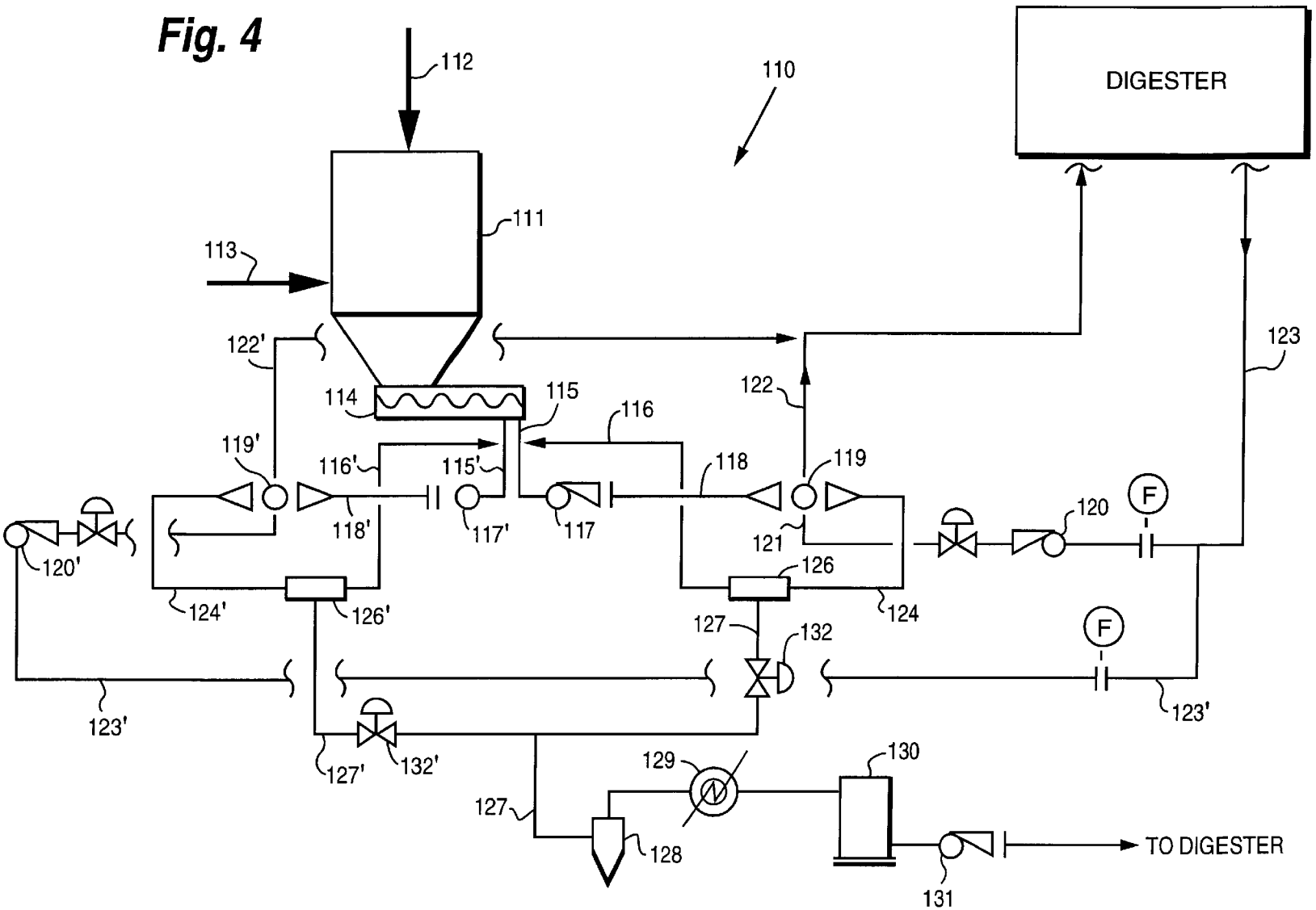
FIG. 4 is a view like that of FIG. 1 for a second embodiment of an exemplary system according to the invention.

FIG. 4 illustrates another embodiment of this invention for feeding one or more digesters in a high-capacity system requiring two or more flow paths. The system 110 is similar to that shown in FIG. 1, but instead of the metering screw 14 feeding a single conduit 15 (see FIG. 1) the screw of FIG. 4, 114, feeds two conduits, 115 and 115'. Structures shown in FIG. 4 which are similar or identical to those shown in FIG. 1 are prefaced by the numeral "1". The identical components of the second of the two flow paths of FIG. 3 are distinguished by a prime superscript, that is, "'".

In the system 110 of FIG. 4 chips 112 and steam 113 are introduced to a treatment vessel 111 and discharged by a metering device 114, for example, a metering screw. Metering device 114 discharges to a set of essentially identical conduits 115, 115' which feed essentially identical slurry pumps 117, 117', as described above. The pumps 117, 117' then feed two similar high-pressure transfer devices 119, 119', that is, high-pressure feeders, respectively. The output of transfer devices 119, 119' in conduits 122, 122' is combined and fed to a digester (shown schematically). Excess liquor is returned from the digester via conduit 123. The liquor in conduit 123 is divided into two flows 123, 123' and via pumps 120, 120' is used to slurry material from devices 119, 119', as is conventional. Other circulations and devices are used as described with respect to FIG. 1.

Preferably the conduits 115, 115'; pumps 117, 117'; feeders, 119, 119'; etc. are identical. However, the size and capacity of the corresponding devices in the two systems may vary depending upon the desired system requirements. Furthermore, though only two parallel systems are illustrated, it is understood that the scope of this invention includes the use of additional flow paths, for example, three or more feed lines, to feed one or more digesters. These digesters may be continuous or batch digesters for chemically treating comminuted cellulosic fibrous material by any available process including, but not limited to, the kraft (i.e., sulfate), sulfite, soda or soda-AQ, or solvent processes, or any other process that can be adapted to this invention.

Figure 5:
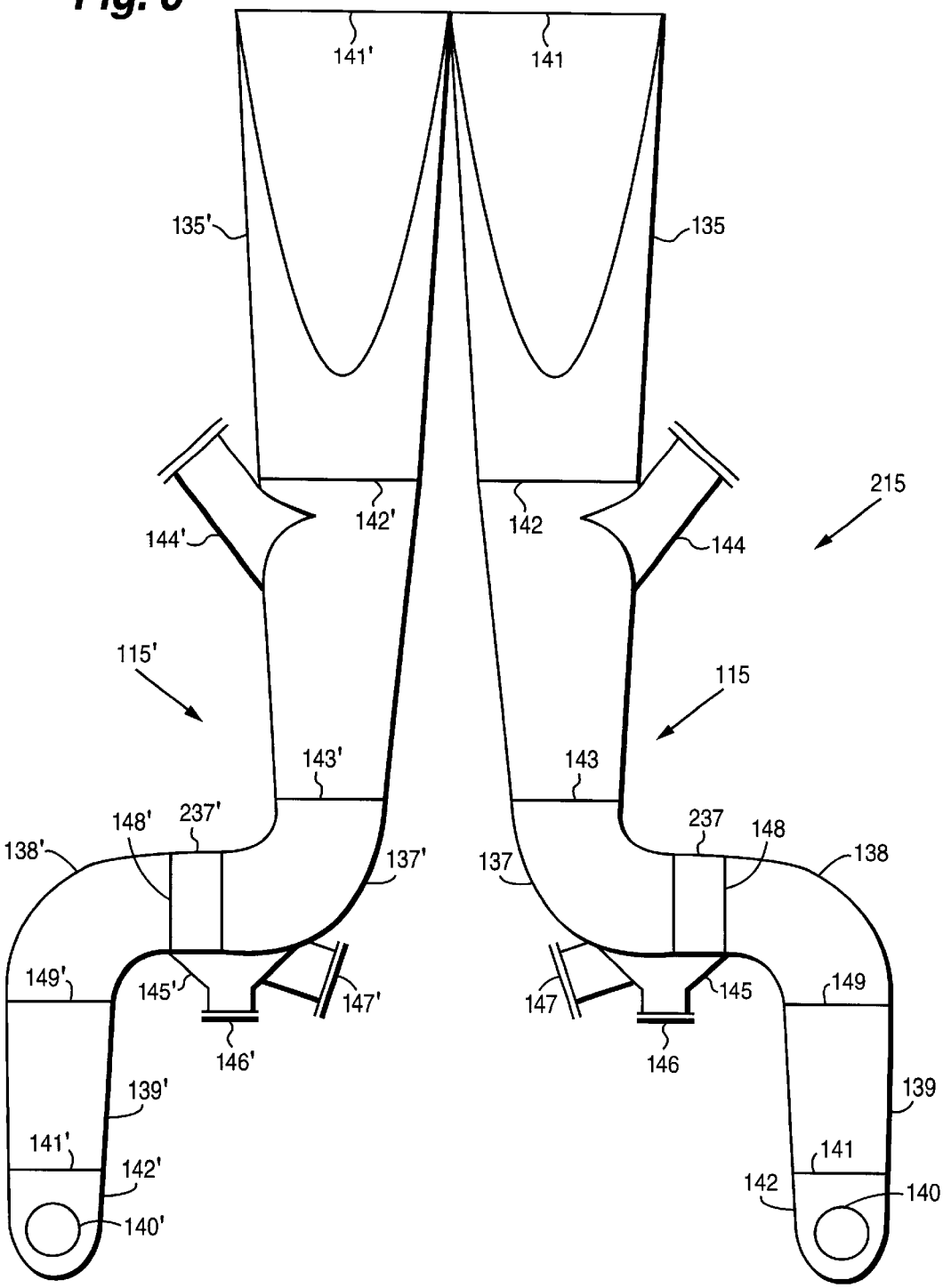
FIG. 5 is a view like that of FIG. 2 for the embodiment of FIG. 4.

FIG. 5 illustrates a detailed design, 215, of the two feed conduits, 115, 115' of FIG. 3. The components of this system, 215, are similar to those shown in single-conduit tramp material removal system of FIG. 2, but having two feed conduits, 115 and 115'. Structures shown in FIG. 5 which are similar or identical to those shown in FIG. 2 are prefaced by the numeral "1". Again, the identical components of the second system of FIG. 5 are distinguished by a prime superscript. The operation of the FIG. 5 system is identical to the operation described in FIG. 2. Also, the alternatives described with respect to FIG. 2 also apply to the system of FIG. 5. Note further that the FIG. 5 embodiment is not limited to two flow paths but three or more flow paths feeding one or more digesters may be used. These flow paths may have substantially the same capacity and equipment, or the capacity and equipment of each flow path may vary.

FIG. 6 illustrates another exemplary means for removing tramp material from the feed system of a digester according to the invention. In this case, the material trap 45 of FIG. 2 is located adjacent the outlet of a screw conveyor, for example, the screw conveyors 14, 114 or FIGS. 1 and 4. FIG. 6 shows the outlet end of a screw conveyor 214. Conveyor 214 comprises or consists of a housing 201 and a flighted conveyor shaft 202 having flights 203. The shaft 202 typically is driven by a conventional electric motor 206 and supported by one or more anti-friction bearings 204. The conveyor 214 housing 201 typically includes a conventional inlet (not shown) and an outlet 205. The inlet typically receives pretreated chips from a treatment vessel, such as vessels 11, 111. The outlet 205 is typically connected to a conduit, for example conduit 115, 35, 135, or 135'; and thus operatively connected to the inlet of a digester.

A distinguishing feature or the FIG. 6 embodiment of the invention is the cavity 245 located adjacent the outlet 205. Similar to cavities 45 and 145, cavity 245 is located in the bottom of housing 201 such that any dense tramp material that may be present in the flow of chips tends to collect in the cavity 245 before the chips are discharged via outlet 205. As for cavity 45 (see FIGS. 2 and 3), cavity 245 is provided with a liquid inlet 247 for introducing liquids which aid in preventing less dense wood chips from remaining in cavity 245. The lighter material is preferably flushed out of cavity 245 and discharged out of outlet 205 with the rest of the chips. Cavity 245 is also provided with an outlet 246 for removing tramp material which accumulates in the cavity. This removal may be continuous or intermittent (as described above with respect to FIG. 3). Cavity 245 may also include a baffle 60 (see FIG. 3) for aiding the retention of tramp material in the cavity. This baffle may be located within the cavity, for example on the downstream edge of the cavity. to prevent interference with the flights of screw 203.

The more dense, tramp material, solids flow into the cavity 245 due to density differences between the tramp material and the slurry, and as a result of the rotating screw 203 moving the more dense tramp material outwardly toward the housing 201. By providing the cavity 245 adjacent the outlet 205 the action of the screw 203 allows most of the tramp material to be moved to the vicinity of the housing 201; and especially if the cavity 245 has a linear length greater than the horizontal dimension of one of the flights of the screw 203, the majority of the tramp material can be expected to move into the cavity 245.

Figure 7:
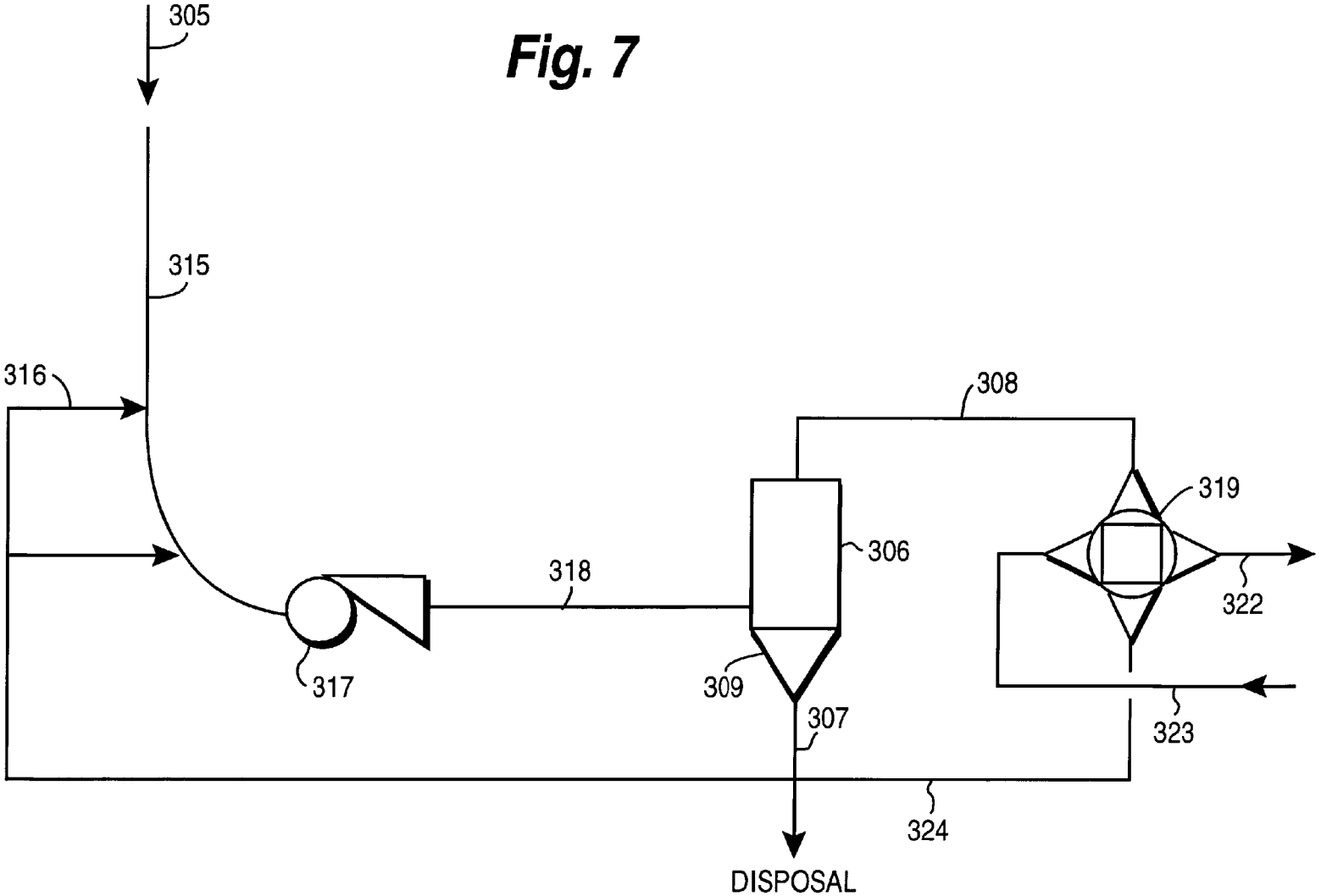
FIG. 7 is a view like that of FIG. 6 of another exemplary tramp material separator system according to the invention.

FIG. 7 illustrates still another embodiment of means for removing undesirable tramp material from the feed system of a digester according to the invention. In the FIG. 7 embodiment the material separation is effected downstream of the slurry pump 317 by a cyclone type separator. Some of the components of FIG. 7 are similar or identical to the components of FIGS. 1 and 4. These components are distinguished from the earlier components by the prefaced numeral "3".

In FIG. 7, pretreated chips 305, for example, from screw conveyor 14, 114, 214, are introduced to conduits 315 which feeds slurry pump 317. Liquor is added to the chips by one or more conduits 316. The slurry pump 317 discharges the pressurized slurry to conduit 318. Conduit 318 introduces the pressurized slurry to conventional cyclonetype separator 306. The slurry is preferably introduced tangentially to the separator 306 so that the slurry flows in a helical vortex within the separator 306. Due to the combined effects of gravity and centrifugal acceleration, the denser tramp material (for example, sand, stones, knots) passes to the bottom of the separator 306 and is discharged to conduit 307 and to disposal. The less dense cellulose material is discharged from the top of the separator 306 to conduit 308 and to the conventional HPF 319. Though the separator 306 is shown schematically having a conical discharge 309, the shape of the discharge 309 need not be conical, but may simply be cylindrical, depending upon the type of known separator 306 utilized.

Figure 8:
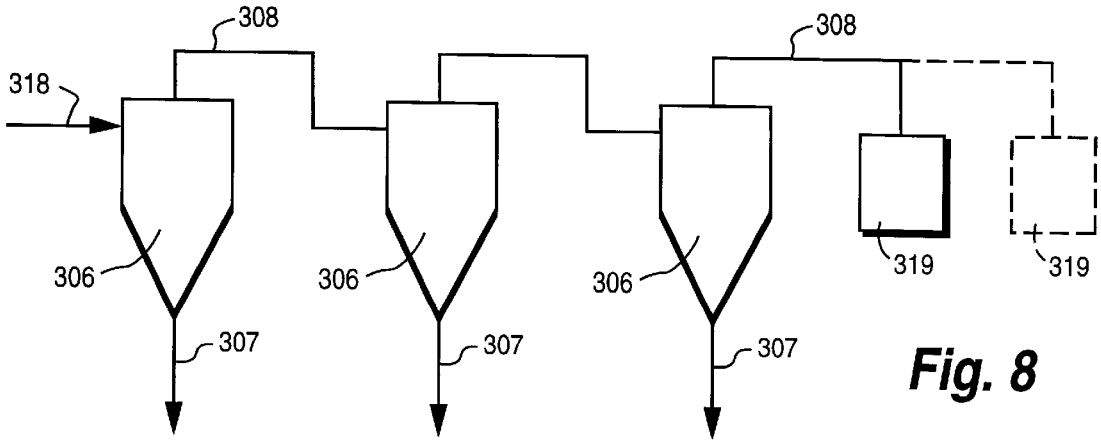
FIGS. 8 and 9 are modified forms of the system of FIG. 7 showing a plurality of cyclone separators associated with one or more feeder devices.
Figure 9:
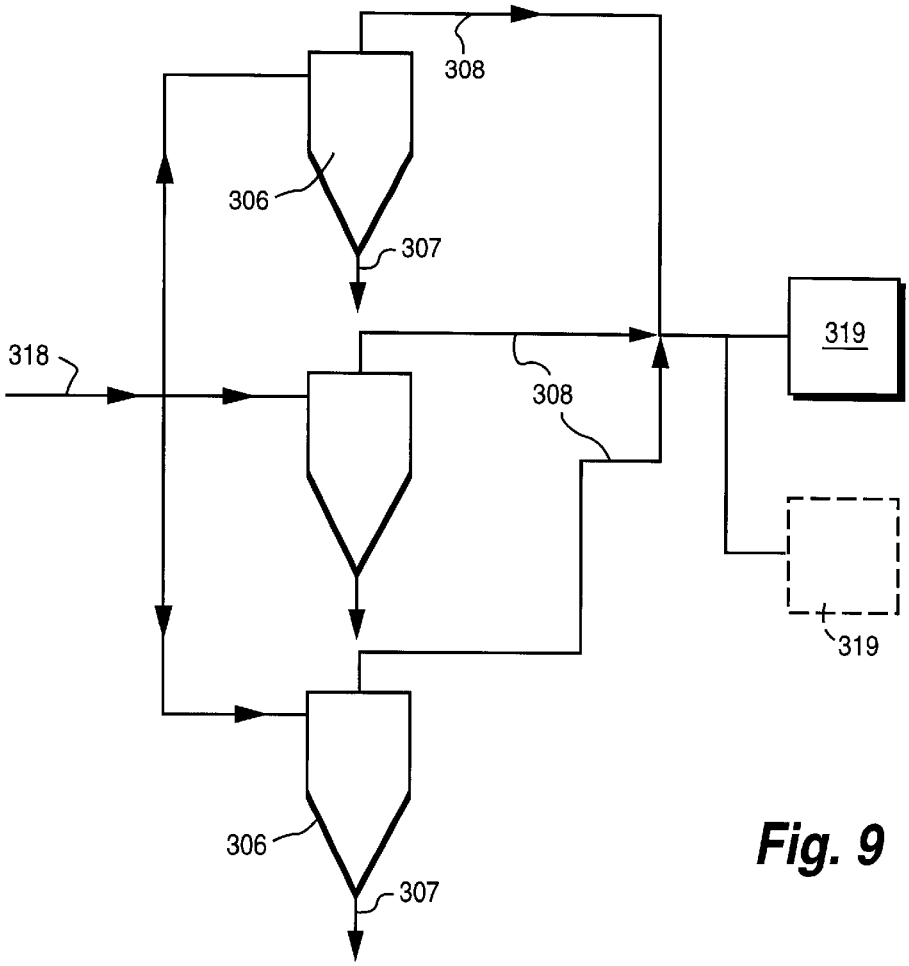

The slurry is transferred from HPF 319 to further treatment via conduit 322 and excess liquor is returned via conduit 323, as is conventional. Also, excess liquor removed from the low pressure outlet of the feeder 319 is typically returned to be used as a source of the liquor in conduit 316. More than one separator 306 may be used; for example, two or more separators 306 may be used in series to feed one or more feeders 319 as seen schematically in FIG. 8, or two or more separators may be used in parallel to feed one or more devices 319, as seen schematically in FIG. 9. Other conventional devices, as shown in FIG. 1, may be located or associated with conduit 324, such as an In-line Drainer, Level Tank, cooler, or even a conventional Sand Separator.

Though not illustrated in these figures, the present invention also encompasses a method and apparatus for separating tramp material in which the sytem of FIG. 2 is located in the position of separator 306 of FIG. 7. In other words, the radiused elbow 37 and cavity 45 may also be located in the conduit connecting pump 317 and feeder 319 of FIG. 7.

It will thus be seen that according to the present invention a desirable variety of tramp material separators, as well as chemical cellulose pulp digester feed systems having such separators therein, and a method of separating tramp material from a slurry of cellulosic fibrous material, have been provided. While the invention has been shown and described in what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and methods.

What is claimed is:

1. A separator tramp metal separator for use in a comminuted cellulosic fibrous material slurry feed system, comprising:

a conveyor for feeding comminuted cellulosic fibrous material, including at least some tramp material, comprising: a housing having a first end and a second end; an inlet located adjacent said first end; an outlet adjacent said second end; and a screw conveyor having conveyor flights on a rotatable shaft generally concentric with said housing, and extending from said first end to said second end for conveying the fibrous material from said inlet to said outlet and moving tramp material radially outwardly toward said housing;

a cavity formed in said housing located substantially beneath at least one of said screw conveyor flights, and adjacent said outlet, for collecting tramp material; and an outlet from said cavity through which the collected tramp material from said cavity is removed;

further comprising a liquor inlet in said cavity for introducing liquid to said cavity so that the liquid agitates and conveys the desirable fibrous material from said cavity to said housing outlet while allowing the undesirable tramp material to collect in said cavity.

2. A separator as recited in claim 1 further comprising a baffle in said cavity which aids in the retention of tramp material in said cavity, said baffle positioned so as not to interfere with said conveyor flights.

3. A separator as recited in claim 1 wherein said cavity has a linear length along said housing, substantially parallel to said conveyor shaft, greater than the dimension along said shaft of at least one of said screw conveyor flights above said cavity.

4. A separator as recited in claim 3 wherein said screw conveyor shaft is substantially horizontal and said cavity outlet is substantially perpendicular thereto.

5. A separator as recited in claim 4 wherein said shaft is mounted on one or more anti-friction bearings, and is rotated by an electric motor.

6. A separator as recited in claim 1 wherein said screw conveyor shaft is substantially horizontal and said cavity outlet is substantially perpendicular thereto.

7. A chemical cellulose pulp digester feed system comprising:

a chip bin, a metering device, a conduit for entraining comminuted cellulosic material from said metering device in cooking liquor to provide a slurry, and a transfer device which pressurizes the slurry for feeding it to a digester; and said metering device comprising a substantially horizontal axis metering screw having a housing with an inlet, an outlet, a rotating screw extending between said inlet and said outlet inside said housing, and a tramp material separator between said inlet and said outlet;

wherein said tramp material separator comprises a cavity adjacent said outlet, and extending downwardly from said screw housing so that more dense, tramp material, solids will flow into said cavity due to density differences between the tramp material and the slurry, and as a result of said rotating screw moving the more dense tramp material outwardly toward said housing;

further comprising means for establishing a purge flow of fluid into said cavity for effecting movement of less dense solids that flow into said cavity back out of said cavity while allowing more dense tramp material to flow into said cavity.

8. A system as recited in claim 7 further comprising means for intermittently removing the tramp material from said cavity.

9. A system as recited in claim 7 wherein said screw conveyor comprises a rotating shaft with a plurality of flights thereon, including at least one flight above said cavity; and wherein said cavity has a linear length along said housing, substantially parallel to said conveyor shaft, greater than the dimension along said shaft of at least one of said screw conveyor flights above said cavity.

10. A chemical cellulose pulp digester feed system comprising:

a chip bin, a metering device, a conduit for entraining comminuted cellulosic material from said metering device in cooking liquor to provide a slurry, and a transfer device which pressurizes the slurry for feeding it to a digester; and said metering device comprising a substantially horizontal axis metering screw having a housing with an inlet, an outlet, a rotating screw extending between said inlet and said outlet inside said housing, and a tramp material separator between said inlet and said outlet;

wherein said tramp material separator comprises a cavity adjacent said outlet, and extending downwardly from said screw housing so that more dense, tramp material, solids will flow into said cavity due to density differences between the tramp material and the slurry, and as a result of said rotating screw moving the more dense tramp material outwardly toward said housing;

further comprising a baffle in said cavity which aids in the retention of tramp material in said cavity, said baffle positioned so as not to interfere with said rotating screw.

11. A chemical cellulose pulp digester feed system comprising:

a chip bin, a metering device, a conduit for entraining comminuted cellulosic material from said metering device in cooking liquor to provide a slurry, and a transfer device which pressurizes the slurry for feeding it to a digester;

said metering device comprising a conveyor for feeding comminuted cellulosic fibrous material, including at least some tramp material, comprising: a housing having a first end and a second end; an inlet located adjacent said first end; an outlet adjacent said second end; and a screw conveyor having conveyor flights on a rotatable shaft and generally concentric with said housing, and extending from said first end to said second end for conveying the fibrous material from said inlet to said outlet and moving tramp material radially outwardly toward said housing;

a cavity formed in said housing located substantially beneath at least one of said screw conveyor flights, and adjacent said outlet for collecting tramp material; and an outlet from said cavity through which the collected tramp material from said cavity is removed;

further comprising a liquor inlet in said cavity for introducing liquid to said cavity so that the liquid agitates and conveys the desirable fibrous material from said cavity to said housing outlet while allowing the undesirable tramp material to collect in said cavity.

* * * * *